United States Patent [19]

Tavor

[11] 4,111,607

[45] Sep. 5, 1978

[54] LINEAR HYDRAULIC MOTOR

[75] Inventor: Chanany Tavor, Carmiel, Israel

[73] Assignee: Amiad Systems Ltd., Kibbutz Amiad, Israel

[21] Appl. No.: 738,058

[22] Filed: Nov. 2, 1976

Related U.S. Application Data

[63] Continuation-in-part of Ser. No. 659,813, Feb. 20, 1976, abandoned, which is a continuation of Ser. No. 437,102, Jan. 28, 1974, Pat. No. 3,939,755.

[51] Int. Cl.[2] ..... F04B 49/00; F04B 49/08

[52] U.S. Cl. ..... 417/46; 417/403

[58] Field of Search ..... 91/224–227, 91/229, 235, 342; 417/403

[56] References Cited

U.S. PATENT DOCUMENTS

| | | | |
|---|---|---|---|
| 1,965,038 | 7/1934 | Hartman | 91/226 |
| 2,276,783 | 3/1942 | Kennedy | 91/225 |
| 2,851,013 | 9/1958 | Doughton | 91/224 |
| 2,966,893 | 1/1961 | Deitrickson | 91/225 |
| 2,966,894 | 1/1961 | Deitrickson | 91/224 |

FOREIGN PATENT DOCUMENTS

| | | | |
|---|---|---|---|
| 1,312,051 | 11/1962 | France | 417/403 |

*Primary Examiner*—William L. Freeh
*Attorney, Agent, or Firm*—Donald M. Sandler

[57] ABSTRACT

A hydraulic motor comprising a cylinder, a stepped piston reciprocatable in said cylinder and having relatively proportioned leading and trailing surfaces, the surfaces together with axially directed surfaces defining, with the cylinder walls, first, second and intermediate cylinder zones, which intermediate cylinder zone is sealed with respect the first zone, valve controlled inlet and outlet of said cylinder in communication with said first zone, a water inlet of said cylinder in communication with the intermediate zone, piston wall portions defining a cylindrical recess opening out into the second zone and passages serving to effect communication between the recess and the second and intermediate zones, a tubular spool valve rod, apertured adjacent one end thereof and formed adjacent an opposite end thereof with a pair of axially spaced apart flanges fitting slidingly into the cylindrical recess, the rod having formed thereon an outwardly directed abutment located intermediate the flanges and the one end of the rod, the rod having relatively proportioned leading and trailing surfaces and being reciprocatable with respect to the piston between a first position wherein the second and intermediate zones communicate with each other and wherein there is defined between the opposite end of the rod and a wall of the recess, a region in communication with the interior of the spool valve rod and to which an end surface of said rod is exposed, and a second position wherein the second and intermediate zones are sealed with respect to each other; the rod extending sealingly and slidably through a cylinder wall and being displaceable with respect to the cylinder between a first location wherein the rod apertures communicate with the second zone and a second location wherein the abutment abuts the cylinder wall, the apertures communicating with the outside of the cylinder when the rod is in the second locations and in locations intermediate the first and second locations.

8 Claims, 11 Drawing Figures

LINEAR HYDRAULIC MOTOR

Figure 1:
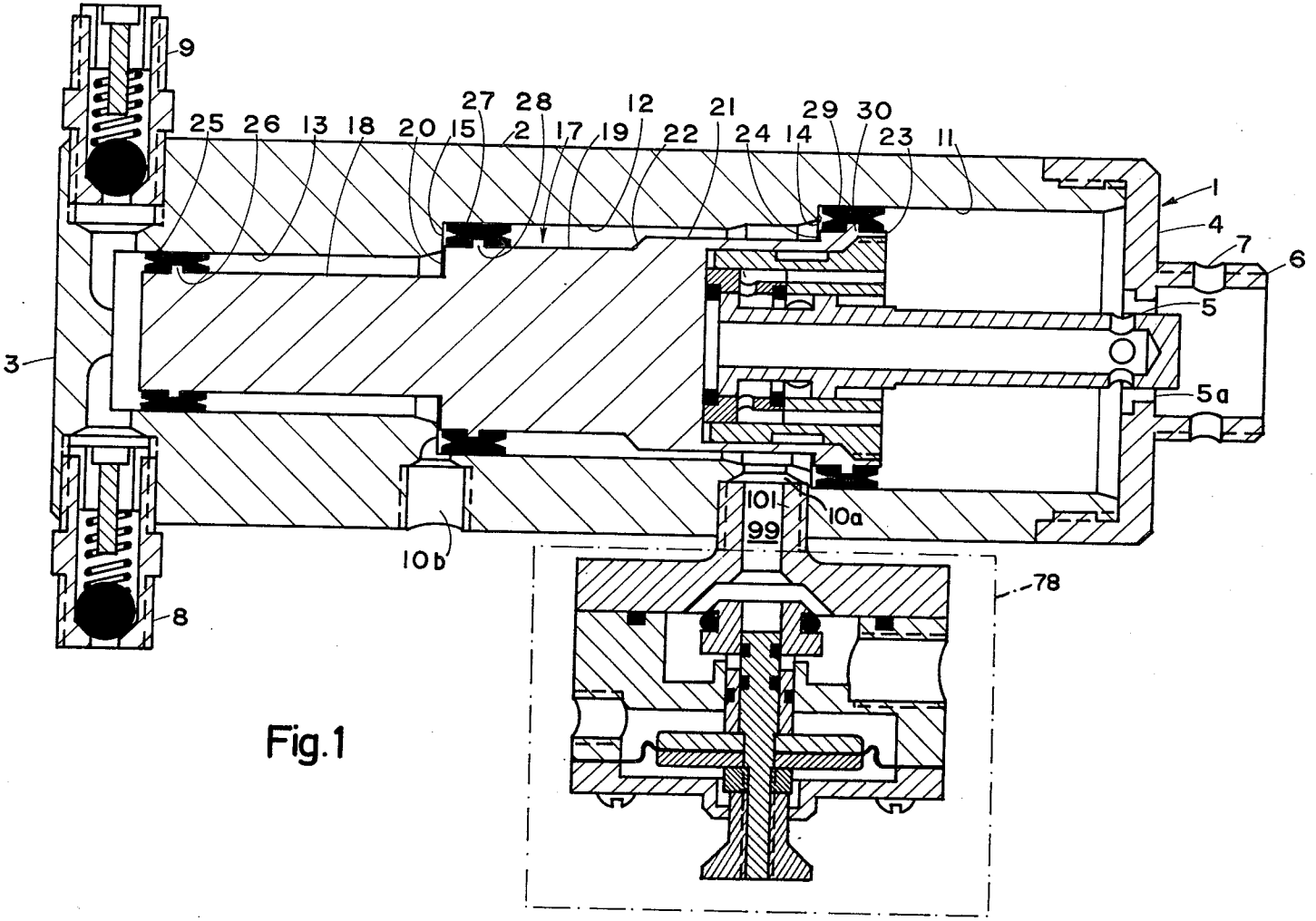

The present invention relates to a hydraulic motor and is a continuation-in-part of application Ser. No. 659,813 filed Feb. 20, 1976 (now abandoned) which is itself a continuation of U.S. application Ser. No. 437,102, filed Janu. 28, 1974, now issued as U.S. Pat. No. 3,939,755.

The hydraulic motor, the subject of the present application constitutes an improvement in and modification of the hydraulic motor disclosed in U.S. Pat. No. 3,939,755.

In co-pending application Ser. No. 659,813, whose disclosure is incorporated by way of reference, there is disclosed and described a linear hydraulic motor for operation by a liquid under pressure, comprising:

a stepped cylinder casing having: a front cover, a large bore portion in its front part closed by said front cover, a smaller bore portion in its rear part, and a liquid inlet in the rear of the large bore;

a differential piston unit reciprocable in the cylinder casing, said unit consisting of a large diameter front piston slidingly movable in the large bore portion, and of a smaller-diameter rear piston slidingly movable in the smaller-diameter bore, said piston unit having a smooth central bore whose front end extends through the front end of the large-diameter piston whereat the bore diameter is narrowed by an inwardly projecting stop, and the central bore's rear end being within the confines of the smaller-diameter piston, said central bore providing a first fluid communication path with said large-bore portion through a first port extending from the front end of the piston to a point distanced from the central bore's rear end, and a second port extending between a surface of the smaller-diameter piston and the central bore at a point situated to the front of the first port, and providing a second fluid communication path between the central bore and said liquid inlet, a hollow spool valve adapted to slide in the central piston bore in reciprocal motion from a frontal position in the bore defined by contact of the valve's front end with the said stop to a rearward position defined by contact of the valve's rear end with the rear end of the central bore, said spool valve comprising a front collar, a rear collar and an annular groove extending between the two collars, the valve being elongated towards the front in the shape of a cylindrical outlet tube which is guided in a bore provided in the front cover of the casing and protrudes through this cover to the outside, an outer limit stop and an inner limit stop on said tube adapted to alternately contact the outer and the inner surfaces of the front cover, the outer stop being positioned on the tube so as to define, by its contact with the front cover, the rear limit of the piston stroke during the front position of the spool valve in the central bore, and the inner stop being positioned on the tube so as to define by its contact with the front cover, the front limit of the piston stroke during the rearward position of the spool valve in the central bore, a central port in the spool valve opening at the rear end of the spool valve and extending through the outlet tube to a point short of the front end of this tube where it is in fluid communication with the atmosphere through at least one radial opening positioned to the rear of the outer limit stop, disposition of said first and second ports in the piston unit being such that in the frontal position of the piston unit with the spool valve in its rear position, fluid communication is created between the liquid inlet and the large-bore cylinder through the first port, the annular groove and the second port, and that in the rear position of the piston unit with the spool valve in its frontal position, fluid communication is created between the large-bore cylinder and the atmosphere through the first port, the rear end of the central bore, the central valve port, and the radial opening at the end of the outlet tube.

According to the present invention there is provided a hydraulic motor comprising a cylinder, a stepped piston reciprocatable in said cylinder and having relatively proportioned leading and trailing surfaces, said surfaces together with axially directed surfaces defining, with the cylinder walls, first, second and intermediate cylinder zones, which intermediate cylinder zone is sealed with respect the first zone, valve controlled inlet and outlet of said cylinder in communication with said first zone, a water inlet of said cylinder in communication with said intermediate zone, piston wall portions defining a cylindrical recess opening out into said second zone and passages serving to effect communication between said recess and said second and intermediate zones, a tubular spool valve rod, apertured adjacent one end thereof and formed adjacent an opposite end thereof with a pair of axially spaced apart flanges fitting slidingly into said cylindrical recess, said rod having formed thereon, an outwardly directed abutment located intermediate said flanges and said one end of said rod, said rod having relatively proportioned leading and trailing surfaces and being reciprocatable with respect to said piston between a first position wherein said second and intermediate zones communicate with each other and wherein there is defined between said opposite end of said rod and a wall of said recess, a region in communication with the interior of the spool valve rod and to which an end surface of said rod is exposed, and a second position wherein said second and intermediate zones are sealed with respect to each other; said rod extending sealingly and slidably through a cylinder wall and being displaceable with respect to said cylinder between a first location wherein the rod apertures communicate with said second zone and a second location wherein said abutment abuts said cylinder wall, said apertures communicating with the outside of the cylinder when said rod is in said second locations and in locations intermediate said first and second locations.

As in the case of the motor disclosed in the parent patent the reciprocating movement of the piston is controlled by the displacement of the spool valve rod. However, unlike the arrangement disclosed in the parent patent, the displacement of the spool valve rod does not arise out of the abutment of an end disc located externally with respect to the cylinder and formed integrally with an end of the rod and the cylinder. Displacement of the spool valve rod is effected rather, in accordance with the present invention by the generation of a suitable displacing pressure in the region defined between the opposite end of the rod and the wall of the recess which region is in communication with the interior of the rod.

In accordance with preferred embodiments of the present invention the piston wall portions defining the recess and the passages are constituted by one or more tubular inserts.

In accordance with a still further aspect of the present invention there is provided a cut-off valve for use with a hydraulic motor comprising a valve casing, a flexible diaphragm mounted in said casing and serving to divide said casing into two separate casing compartments, a first casing inlet, a throughflow chamber formed in the casing and communicating with said throughflow chamber, and a second casing inlet communicating with one of said compartments, the other compartment communicating with the atmosphere, an annular valve member coupled to said diaphragm by means of a tubular extension and extending into said throughflow chamber and diaplaceable with said diaphragm into closing or opening said throughflow chamber, a control rod sealingly and slidingly extending through said tubular extension and through said diaphragm and out of the casing, said tubular extension being apertured, said rod being displaceable between a first position wherein said rod seals said apertures and a second position wherein said apertures are open and communication can be effected between said throughflow chamber and the interior of said extension.

Such a cut-off valve is designed for use when the motor is employed for example to inject a liquid such as, for example, a fertilizer liquid into an irrigation pipe, a portion of the water flowing through the pipes being designed to actuate the motor. When the source of the liquid (for example the fertilizer liquid) to be injected into the irrigation pipe becomes exhausted it is necessary to ensure that the motor itself ceases to operate and the cut-off valve is then effective so as to detect the exhaustion of the source of the liquid and so as to cut off the operation of the motor.

Figure 2:
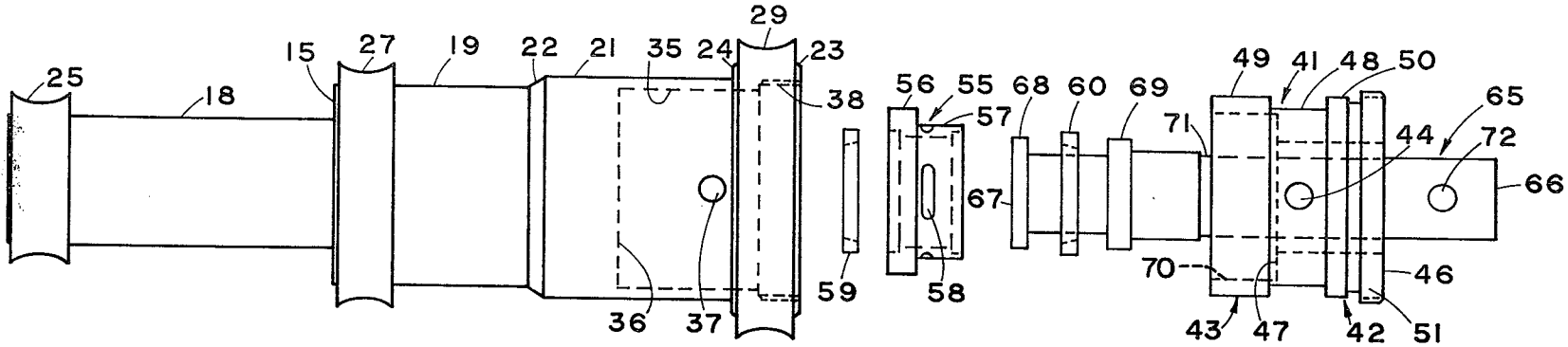
Figure 3:
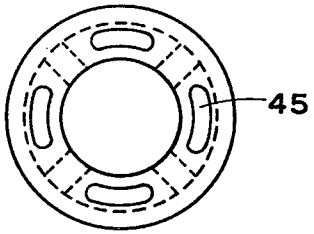
Figure 10:
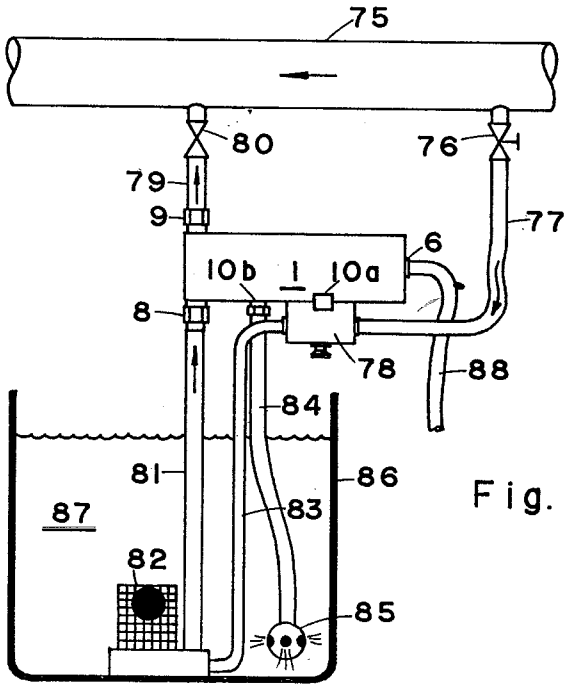
Figure 11:
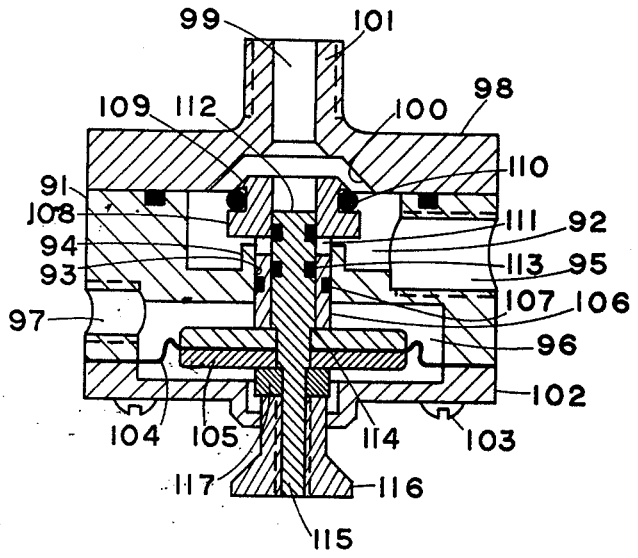

One embodiment of a hydraulic motor in accordance with the present invention will now be described by way of example and with reference to the accompanying drawings in which:

FIG. 1 is a longitudinally sectioned side elevation of one embodiment of hydraulic motor in accordance with the present invention, FIG. 2 is an exploded side elevation of a piston and spool valve assembly incorporated in the motor shown in FIG. 1, FIG. 3 is a plan view from above of a component of the assembly shown in FIG. 2, FIGS. 4 through 9 are respective longitudinally sectioned side elevations of the hydraulic motor shown in FIG. 1 in respectively differing stages of operation and with a portion of an outer cylinder wall cut away, FIG. 10 is a schematic illustration of the incorporation of the hydraulic motor in a system for introducing a liquid fertilizer into an irrigation installation, and FIG. 11 is a longitudinally sectioned side elevation of a cut-off valve incorporated in the system shown in FIG. 10.

As seen in FIG. 1 of the drawings a hydraulic motor 1 comprises a cylinder 2 having a planar end wall 3 disposed in what will hereinafter be referred to as the front end of the motor. The opposite end of the cylinder 2, disposed in what will hereinafter be referred to as the rear end of the motor, is screw fitted to an end cap 4 having a centrally located aperture 5 bounded by an outwardly directed, outwardly threaded tubular boss 6 in whose walls are formed turning apertures 7. The aperture 5 is rimmed by a bushing 5*a*. Formed in the cylinder 2 adjacent the front end 3 is a pair of oppositely directed bores in which are screw fitted uni-directional inlet and outlet valves 8 and 9. The cylinder is formed with a tapped inlet aperture 10*a* and a tapped sitter aperture 10*b*.

The inner cylindrical wall of the cylinder 2 is progressively stepped along its axial length so as to form successive cylinder portions 11, 12, and 13 of progressively reducing diameter. The cylinder portion 11 merges with the cylinder portion 12 via a shoulder 14 and the cylinder portion 12 merges with the cylinder portion 13 via a shoulder 15.

Slidably located in the cylinder 2 is a piston 17 which is successively stepped along its axial length so as to form a first piston portion 18 which merges with a succeeding piston portion 19 of larger diameter via a shoulder 20, the piston portion 19 merging with a piston portion 21 via an inclined shoulder 22, the piston portion 21 terminating in an annular flange 23 which presents a shoulder surface 24.

A first piston ring 25 is fitted to a peripheral rib 26 of the piston portion 18 so that a front edge of the piston ring 25 is located adjacent to the front end of the piston portion 18. A piston ring 27 is fitted to a peripheral rib 28 to the piston portion 19 so that a front edge of the piston ring 27 is located adjacent to the shoulder 20. A piston ring 29 is fitted to a peripheral rib 30 so that a front edge of the piston ring 29 is located adjacent to the surface 24.

As can be seen from FIG. 1 of the drawings and, more clearly from FIGS. 2 and 3 to which specific attention is now directed to piston protion 21 is, over a major portion of its length, formed as a hollow cylinder having a cylindrical wall 35 and a base surface 36. Apertures 37 are formed in the cylindrical wall 35 and are equiangularly distributed around the wall. The cylindrical wall 35 terminates at its end remote from the base 36 in a tapped rim portion 38.

A tubular insert 41 is adapted to be located within the hollow cylinder of the piston portion 21 and comprises an axial, thick wall portion 42 and an axial thin wall portion 43. Extending through the thick wall portion 42 are a plurality of apertures 44 which are equiangularly distributed around the insert 41. Formed in the thick wall portion 42 are a plurality of axially directed passages 45 (seen clearly in FIG. 3 of the drawings) which are equiangularly spaced around the insert so that each aperture 44 is disposed between a pair of successive passages 45. The passages 45 extend from an end face 46 of the insert to a shoulder 47 which marks the end of the thick wall portion 42. Formed on the outer surface of the insert 41 is a peripheral recess 48 from which extend the apertures 44 and which is bounded on either side by peripheral flange portions 49 and 50 so dimensioned as to form a close sliding fit within the cylindrical walls 35. The insert 41 is formed with an externally threaded end flange 51 which can be screwed into the tapped rim 38 of the cylindrical wall 35.

A tubular member 55 is formed with a flange portion 56 and a cylindrical wall portion 57 there being formed in the latter peripherally elongated apertures 58 which are distributed equiangularly around the wall 57. The flange portion 56 is so dimensioned as to form a close sliding fit within the end flange 49 of the insert 41. When so fitted, the cylindrical portion 57 is spaced away from the surrounding inner wall surface of the insert 41 so as to define a continuation of the axial passages 45 formed in the insert 41. The end faces of the tubular member 55 are recessed so as to be capable of accommodating respective, resiliently flexible abutment rings 59 and 60.

A hollow spool valve rod 65 has one closed end 66 and an opposite open end 67 rimmed by an end flange 68, a further flange 69 being axially spaced therefrom. The two flanges 68 and 69 define therebetween a recess 70. A shoulder 71 is formed on the rod 65 axially spaced from the flange 69. The external diameter of the flanges 68 and 69 is such as to allow for the flanged portions to form a sliding fit within the thick walled portion 42 of the insert 41 and the tubular member 55. Formed in the rod, adjacent the closed end 66 thereof, are a plurality of outlet apertures 72 which are equiangularly distributed around the rod 65.

The assembly of the piston and spool valve is as follows: With the parts relatively disposed as shown in FIG. 2 of the drawings, i.e. with the insert 1 surrounding the spool rod 65 and with the abutment ring 60 surrounding the recess 70, the flanged end of the spool rod 65 is inserted into the tubular member 55 so that the abutment ring 60 is located in the recess 70 of the tubular member 55. The tubular member 55 is then inserted into the insert 41 and pushed home with the flanged rim 56 forming a close sliding fit within the flanged end 49 and with the abutment ring 60 firmly retained between the recessed end of the wall 57 and the adjacent end face 47 of the thick wall portion 42.

With the flanged end 68 of the spool rod 65 located within the tubular member 55 and with the abutment ring 59 located in the recess formed in the flange 56, the assembly consisting of the insert 41, the tubular member 55 and the rod 65 together with the abutment rings 68 and 69 are introduced into the hollow portion of the piston portion 21 and the threaded flange 51 is screwed home in the tapped rim 38 until, as seen in FIG. 1 of the drawings, the flanged end 56 of the tubular member 65 bears against the base 36 and the abutment ring 59 is retained in position within the recessed rim by abutting against the base 36. In this position the spool rod 65 is axially reciprocatable with respect to the piston between a first position in which the flanged end 68 bears against the abutment ring 59 and a second position wherein the flanged end 68 bears against the abutment ring 60. The presence of the abutment ring 60 presents the displacement of the spool rod 65 out of the piston.

The assembled piston and spool valve is then introduced into the cylinder and the cap 4 screwed home so that the spool rod 65 sealingly extends through the bushing 5*a*.

Reference wwill now be made to FIGS. 4 through 7 of the drawings for a description of the mode of operation of the hydraulic motor just described.

Figure 4:
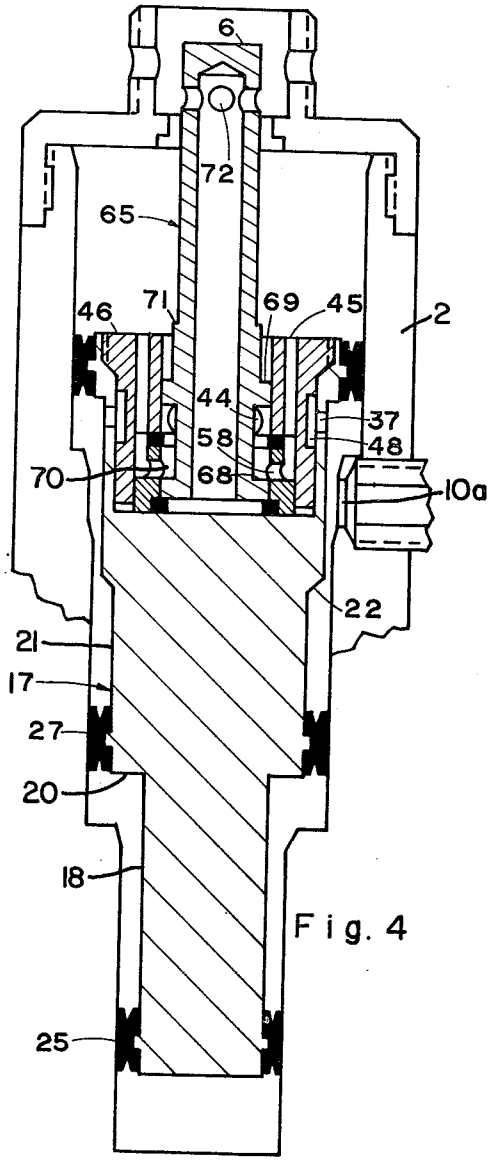

In the disposition shown in FIG. 4 of the drawings water, under pressure enters the cylinder 2 via the water inlet 10*a* and passes through the inlet apertures 37, groove 48, apertures 44, groove 70, apertures 58, axial passages 45 into the rear end of the cylinder to the right of the piston 17. Hydraulic pressure therefore acts on the exposed surface 46 of the piston and the exposed surfaces of the shoulder 71 and flange 69 of the spool rod 65 and this, together with the forwardly directed pressure acting on the piston ring 27 more than counteracts the opposite, rearwardly directed pressure acting on the piston shoulder 22, piston ring 29 and shoulder 24. There is therefore a resultant uncompensated pressure acting on the piston and spool rod in a foward direction. As a consequence, the piston 17 together with the spool rod 65 move forwardly to the left in a compression stroke thereby forcing the contents of the cylinder, to the left of the piston, through the outflow valve 9.

Figure 5:
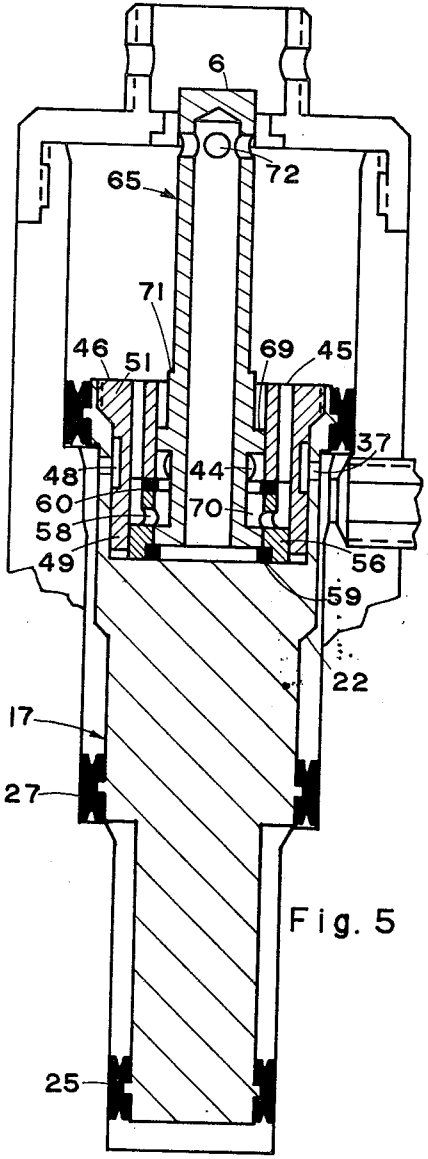
Figure 6:
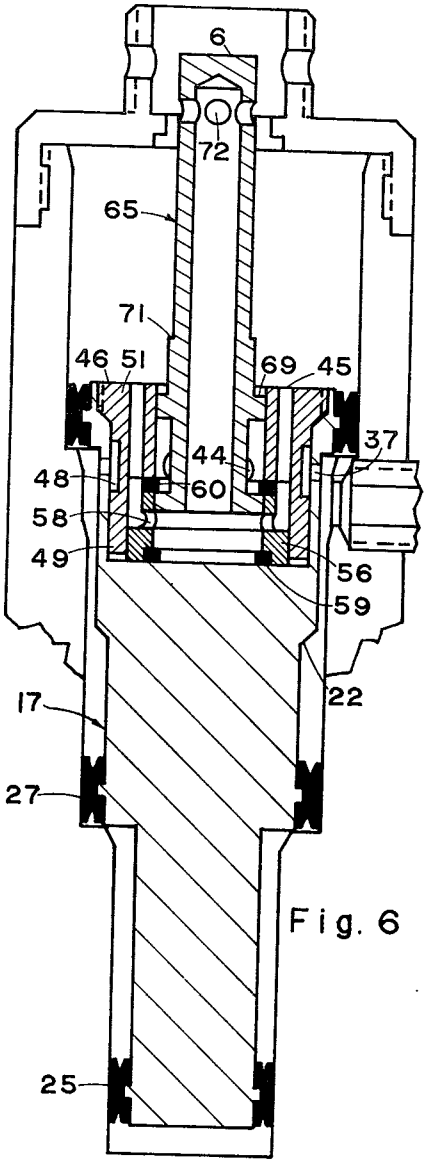

This forwardly directed compression stroke continues until the piston reaches the position shown in FIG. 5 of the drawings towards the end of its stroke wherein the piston ring 27 is about to abut the cylinder shoulder 15 and the sealing ring 29 is about to abut the cylinder shoulder 14. In this position and, as shown in FIG. 5 of the drawings, the forward displacement of the spool rod 65 has been sufficient for the apertures 72 thereof to be put into communication with the righthand end of the cylinder. As a consequence, the water in the righthand end of the cylinder enters the spool rod 65 via the apertures 72 and begins to compress the air therein, the compressed air pressure acting on the exposed surface of the end flange 68 towards the rear end of the motor as does the water acting on the inner end surface of the rod 65 adjacent the holes 72. There is thus created a resultant pressure on the spool rod 65 in a rearward direction and the compressed air in the rod 65 acts as a vertical compressed spring storing energy until the forces acting on the rod are sufficient to propel it to the right into a position, as shown in FIG. 6 of the drawings, wherein it abuts the abutment ring 60. The abutment ring 60 effectively masks a substantial portion of the annular area of the end flange 68 exposed to the forwardly directed water pressure and in consequence there is an increased reesultant force acting on the spool rod 65 in the rearward direction and the spool rod 65 is therefore effectively retained in the position shown in FIG. 6. With this displacement of the spool rod 65 the apertures 72 becomes exposed. Water can no longer flow from the water inlet 10*a* to the righthand end of the cylinder and, on the contrary, the righthand end of the cylinder communicates via the axial passages 45, elongated apertures 58 and the interior of the spool rod 65 with the outlet apertures 72 through which water can escape.

Figure 7:
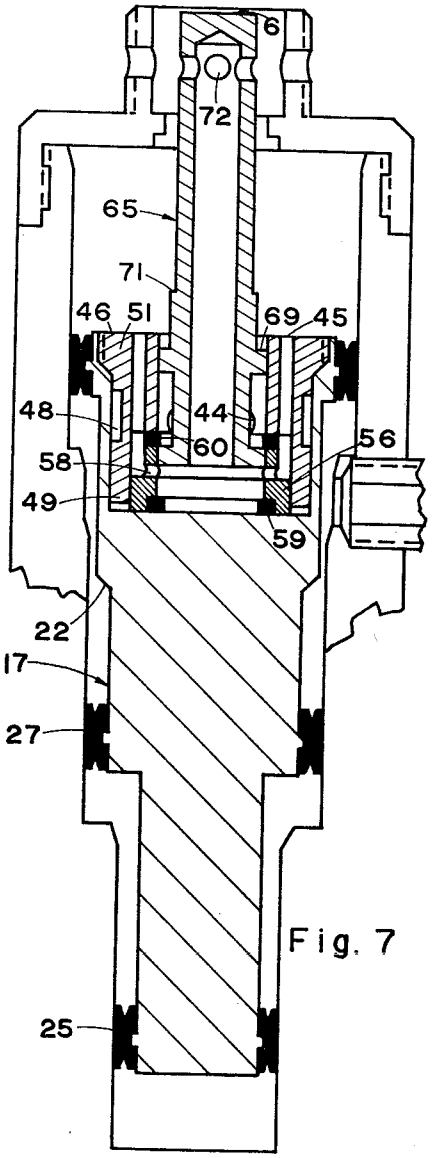

On the other hand, the inflowing water acting on the shoulder 22, the piston ring 29 and the flange surface 24 gives rise to an uncompensated rearwardly directed pressure component acting on the piston and, as a consequence, the piston begins to move to the rear in a suction stroke. As a result, liquid is sucked through the inlet valve 8 into the lefthand side of the cylinder. This rearward displacement of the piston is shown in FIG. 7 of the drawings from which Figure it will also be seen that the spool rod 65 is retained in its rearward position abutting the abutment ring 60 as a consequence of the uncompensated pressure component created by the pressure of the water in the groove 70 (in communication with the water inlet 10*a*) acting on the exposed surface of the flange 69.

Figure 8:
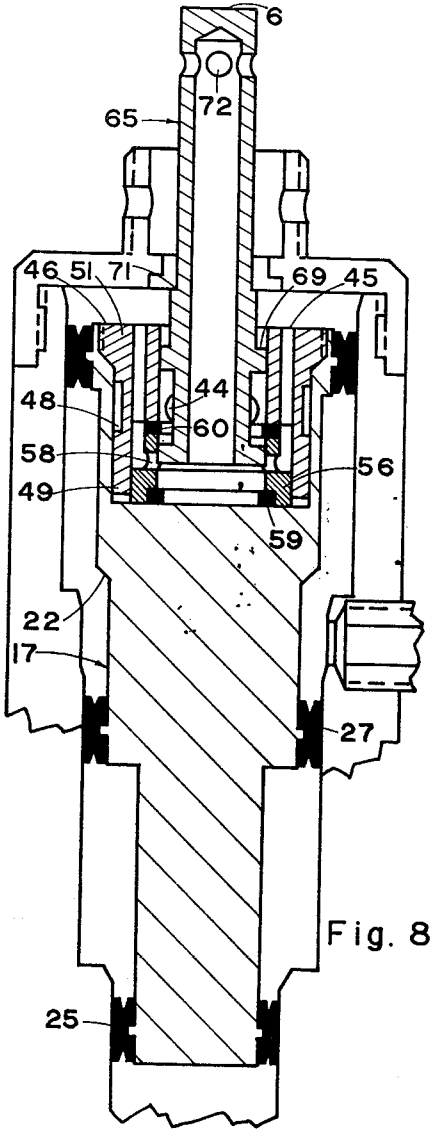
Figure 9:
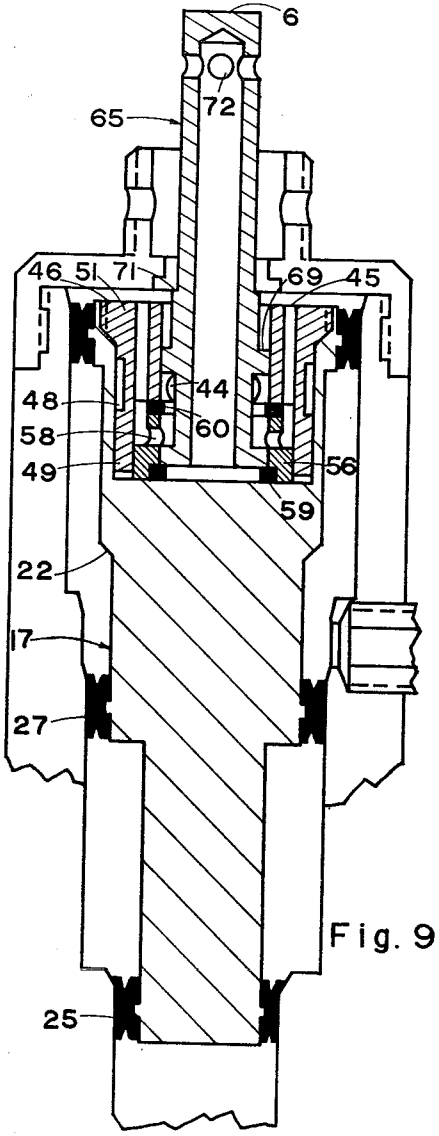

This rearward movement of the piston 17 and spool rod 65 continues until, as seen in FIG. 8 of the drawings, the shoulder 71 of the spool rod 65 abuts the bushing 5*a* whereupon, the continued rearward movement of the piston 17 is no longer accompanied by the rearward movement of the spool rod 65 and, as seen in FIG. 8 of the drawings, the apertures 58 begin to become blocked by the overlying end flange 68 of the spool rod 65.

This blocking of the apertures 58 results, on the one hand, in an increase in pressure on the righthand side of the piston 17 and, on the other hand, in a decrease in pressure on the lefthand side of the flange 68 of the spool rod 65. This differential pressure acting on the exposed surface of the flange 68 results in the spool rod 65 being substantially instantaneously displaced to the left, into abutment with the abutment ring 59. By this time the piston 17 will have substantially reached the end of its suction stroke and the piston 17 and the spool rod 65 will be in the condition shown in FIG. 9 of the drawings. In this position the spool rod 65 is located with respect to the piston 17 as it was located in the position shown in FIG. 4 of the drawings and water now flows from the inlet 10*a* to the righthand side of the piston 17 and the procedure previously described is repeated with the piston 17 being displaced to the left into a compression stroke as before.

Thus it can be seen that the piston 17 reciprocates in the cylinder between compression and suction as a consequence of the limited reciprocation of the spool rod 65 within the piston 17 between abutment rings 59 and 60.

It is a characteristic feature of the construction and operation of this hydraulic motor that the displacements of the spool rod under the differential pressures acting thereon takes place substantially instantaneously. This is attained lby virtue of the fact that compression of fluid gives rise to a storage of energy which when it reaches a certain magnitude overcomes the hydrostatic locking which inhibits displacement.

The incorporation of the hydraulic motor 1, just described, into a system for introducing liquid fertilizer into an irrigation installation will now be described with reference to FIG. 10 of the drawings. As seen in this Figure the irrigation pipe 75 is coupled, at an upstream portion thereof a control valve 76 and tubing 77 with a first inlet of a cut-off valve 78, to be described in detail below with reference to FIG. 11 of the drawings. The valve controlled outlet 9 of the hydraulic motor 1 is coupled via tubing 79 and valve 80 with a downstream portion of the pipe 75. The inlet valve 8 of the motor 1 is coupled via tubing 81 with a float valve controlled inlet 82 which inlet 82 is also coupled, via tubing 83, with a second inlet of the cut-off valve 78. The stirrer inlet 10*b* of the motor 1 is coupled via tubing 84 with a stirrer head 85. Both the valve controlled inlet 82 and the stirrer head 85 are located in a container 86 which accommodates fertilizer liquid 87.

In use, with the flow of irrigation water through the irrigation pipe 75 a portion thereof is tapped off via the tubing 77 and valve 78 and flows into the motor 1 so as to give rise to the reciprocal movement of the piston therein. As a result, fertilizer liquid is drawn out of the container 86 and pumped into the downstream portion of the pipe 75 via the tubing 79. Water emerging from the boss 6 is led away via tubing 88 and is conserved or dissipated as required. When the fertilizer level in the container 86 has fallen to such an extent that the valve controlled inlet 82 is closed (as a result of the sinking of the ball valve) the cut-off valve 78 is actuated, in a manner to be described below, so as to interrupt the flow of water into the motor 1 and this flow can only be resumed by manually reopening the cut-off valve 78, upon the replenishing of the fertilizer container 86.

As has been previously explained the stirrer head 85 is coupled by means of tubing 84 to the stirrer outlet 10*b* of the cylinder. Thus upon the compression stroke of the motor a mixture of air and liquid is forced out of the cylinder through the tube 84 and the stirrer head 85 causing the effective stirring of the fertilizer solution.

Reference will now be made to FIG. 11 of the drawings for a description of the construction and mode of operation of the cut-off valve 78.

As seen in the drawings the cut-off valve 78 comprises a cylindrical body member 91 having formed therein a central cylindrical recess 92 which communicates with an axial bore 93 bounded by an upwardly extending rim 94. The body 91 is formed with a tapped side inlet 95 which communicates with the central recess 92. The body is furthermore formed with a lower, contrally located recess 96 which also communicates with the axial bore 93 and with a tapped inlet 97. The body portion 91 is surmounted by a cap portion 98 to which it is sealingly secured, the cap portion 98 having formed therein a central axial bore 99 bounded at its lower regions by tapering walls 100 and in its upper regions by an upwardly extending, externally threaded coupling boss 101. A circular base member 102 is secured to the body member 91 by means of bolts 103 and snadwiches between itself and the body member 91 a flexible membrane 104 which, is in its turn sandwiched in its central portion between the component parts of a disc member 105 to which it is rigidly secured.

A tubular rod 106 extends through the axial bore formed in the body member 91 and sealed with respect thereto by means of a sealing ring 107. The tubular member 106 is formed integrally with an axially bored valve member 108 formed with tapering walls 109 corresponding to the tapering surface 100, in which tapering walls 108 is located a sealing ring 110. The tube 106 is provided with apertures 111 directly below the valve member 108.

There extends slidingly through the tube 106 a release rod 112 which is sealed with respect to the surrounding tube 106 by a pair of axially spaced apart sealing rings 113. A peripheral shoulder 114 of the release rod 112 rests on the central disc 105 so that the upward displacement of the disc 105 is accompanied by a corresponding upward displacement of the valve member 109 and release rod 112. The lowermost stretch 115 of the release rod 112 is screw coupled to an actuating knob 116 which bears against a washer 117 which, in its turn, bears against the lowermost surface of the disc 105.

In use, the coupling boss 101 is screw coupled into the tapped inlet aperture 10*a* of the motor, the water supply pipe 77 is coupled to the inlet bore 95 and the tube 83 is coupled to the inlet bore 97. As long as sufficient fertilizer liquid remains in the container 86 the valve controlled inlet 82 remains open and fertilizer liquid is sucked through the tube 81 and subsequently pumped into the irrigation pipe 75. When however the fertilizer liquid level has sunk sufficiently for the inlet 82 to be closed the lower end of the tube 81 is closed off and, in consequence, the continued operation of the motor gives rise to a sub-atmospheric pressure in the tube 83 and in consequence in the recess 96.

With the creation of this sub-atmospheric pressure, the atmospheric pressure bearing on the lower surface of the membrane 104 and of the disc 105 displaces the latter upwardly and, with this upward displacement, the valve member 109 together with the release rod 112 are upwardly displaced until the sealing ring 110 bears against the sealing surface 112 thereby sealing off the motor from the water supply and thus interrupting the operation of the motor.

In this way the injection into the irrigation system of sucked up air is avoided. Once the valve body 109 will have been upwardly displaced into its sealing position it will be retained in this position as a consequence of the supply water in the central recess 92 acting on the lower surface of the valve body 108 and this irrespective of whether in the meantime there is no longer a sub-atmospheric pressure acting in the recess 96. When it is desired to open the valve the knob 116 is pulled downwardly causing the release rod 112 to move downwards until the apertures 111 will have been uncovered whereupon water flows from the central recess through the apertures and bears on the upper and sloping surfaces of the valve body pressing the valve body downwardly and thereby opening the valve. It will be realised therefore that a minimal manual effort is required in order to open the valve.

I claim:

1. A hydraulic motor comprising a cylinder, a stepped piston reciprocatable in said cylinder and having relatively proportioned leading and trailing surfaces, said surfaces together with axially directed surfaces defining, with the cylinder walls, first, second and intermediate cylinder zones, which intermediate cylinder zone is sealed with respect the first zone, valve controlled inlet and outlet ports in said cylinder in communication with said first zone, a water inlet of said cylinder in communication with said intermediate zone, piston wall portions defining a cylindrical recess opening out into said second zone and passages serving to effect communication between said recess and said second and intermediate zones, a tubular spool valve rod having an aperture adjacent one end thereof and formed adjacent an opposite end thereof with a pair of axially spaced apart flanges fitting slidingly into said cylindrical recess, said rod having formed thereon an outwardly directed abutment located intermediate said flanges and said one end of said rod, said rod having relatively proportioned leading and trailing surfaces and being reciprocatable with respect to said piston between a first position wherein said second and intermediate zones communicate with each other and wherein there is defined between said opposite end of said rod and a wall of said recess, a region in communication with the interior of the spool valve rod and to which an end surface of said rod is exposed, and a second position wherein said second and intermediate zones are sealed with respect to each other; said rod extending sealing and slidably through a cylinder wall and being displaceable with respect to said cylinder between a first location wherein the rod aperture communicates with said second zone for causing fluid pressure in the second zone to act on said opposite end of said rod to move the rod from its first position relative to the piston to its second position, and a second location wherein said abutment abuts said cylinder wall for causing movement of the piston relative to the rod to relocate the rod from its second position relative to the piston to its first position, said aperture communicating with the outside of the cylinder when said rod is in said second location and in locations intermediate said first and second locations for venting fluid in the second zone.

2. A hydraulic motor according to claim 1 wherein said cylinder is formed with a further outlet aperture in communication with said first zone for coupling to a stirrer head.

3. A cut-off valve for use with a hydraulic motor according to claim 1 comprising a valve casing, a flexible diaphragm mounted in said casing and serving to divide said casing into two separate casing compartments, a first casing inlet, a throughflow chamber formed in the casing and communicating with said first casing inlet, a casing outlet communicating with said throughflow chamber, and a second casing inlet communicating with one of said compartments, the other compartment communicating with the atmosphere, an annular valve member coupled to said diaphragm by means of a tubular extension and extending into said throughflow chamber and displaceable with said diaphragm into closing or opening said throughflow chamber, a control rod sealingly and slidingly extending through said tubular extension and through said diaphragm and out of the casing, said tubular extension being apertured, said rod being displaceable between a first position wherein said rod seals said apertures and a second position wherein said apertures are open and communication can be effected between said throughflow chamber and the interior of said extension.

4. A hydraulic motor according to claim 1 wherein said second position is defined by an abutment carried by a wall of said recess and projecting into said recess and being abutted by one of said valve rod flanges when said valve rod is in said second position.

5. A hydraulic motor according to claim 4 wherein said piston wall portions comprise a tubular insert retained within a cylindrical cavity formed in the piston, a first plurality of throughgoing apertures extending through walls of the insert, each aperture communicating at one end thereof via one or more apertures formed in the piston wall with said intermediate zone, and, at the opposite end thereof with the interior of said insert, and a plurality of axially directed passages formed in the wall of said insert, each passage communicating at one end with said second zone and at the opposite end via a second plurality of apertures formed in said insert with the interior of said insert.

6. A hydraulic motor according to claim 5 wherein said tubular insert consists of a pair of interfitting component inserts, said inserts retaining between them an abutment ring which constitutes said abutment.

7. A hydraulic motor according to claim 6 wherein a second abutment ring is retained between said wall of said recess and said insert to be abutted by said rod when in the first position.

8. A hydraulic motor according to claim 1 wherein said spool valve rod is formed with a peripheral shoulder constituting said outwardly directed abutment, that portion of said rod between said shoulder and said one end being slidable through said cylinder wall.

* * * * *